United States Patent [19]

Adams

[11] Patent Number: 4,817,791

[45] Date of Patent: Apr. 4, 1989

[54] COMBINATION SUITCASE-GARMENT BAG

[76] Inventor: David R. Adams, 3735 Millcrest Rd., Salt Lake City, Utah 84109

[21] Appl. No.: 127,254

[22] Filed: Dec. 1, 1987

[51] Int. Cl.[4] ..... B65D 85/18

[52] U.S. Cl. ..... 206/287.1

[58] Field of Search ..... 206/287.1, 278, 279, 206/288–291

[56] References Cited

U.S. PATENT DOCUMENTS

| | | | |
|---|---|---|---|
| 1,629,362 | 5/1927 | Robert | 206/287.1 |
| 2,325,806 | 8/1943 | Simmons | 206/287.1 |
| 3,881,579 | 5/1975 | Keerdoja . | |
| 3,933,229 | 1/1976 | Pelavin . | |
| 3,958,675 | 5/1976 | Rosenblum . | |
| 4,098,376 | 7/1978 | Pelavin . | |
| 4,391,396 | 7/1983 | Brady . | |
| 4,438,844 | 3/1984 | Kesselman et al. | 206/287.1 |
| 4,542,824 | 9/1985 | Allen | 206/287.1 |
| 4,655,343 | 4/1987 | Lane et al. | 206/287.1 |
| 4,693,368 | 9/1987 | King et al. | 206/287.1 |

FOREIGN PATENT DOCUMENTS

| | | | |
|---|---|---|---|
| 368184 | 3/1932 | United Kingdom | 190/111 |

OTHER PUBLICATIONS

Travelware advertisements, Jul. 1987.

Consumer Reports, Oct. 1987, Carry-on Luggage.

*Primary Examiner*—William Price

*Attorney, Agent, or Firm*—Mallinckrodt & Mallinckrodt

[57] ABSTRACT

A foldable, suitcase-garment bag has flexible, elongate, substantially rectangular front and rear panels secured together to form an interior, garment bag like space between the panels. The bag is adapted to be folded into three overlapping sections and secured in such folded condition wherein the bag is configured similarly to a suitcase. Bottom means are provided to act as a bottom for the bag when in folded condition and a plurality of pockets are provided in at least the front panel of the bag, separate pockets being located in separate sections of the bag when folded. The pockets located in one section of the bag are adapted to expand inwardly into the interior space of the bag when filled while the pockets located in another section of the bag are adapted to expand outwardly when filled, thereby facilitating the folding of the bag into overlapping sections.

19 Claims, 3 Drawing Sheets

COMBINATION SUITCASE-GARMENT BAG

BACKGROUND OF THE INVENTION

1. Field:

The invention is in the field of portable garment bags and bags commonly referred to as carry-on bags which can be carried onto a commercial airliner and stowed beneath the seat.

2. State of the Art:

The modern day business traveler is usually faced with the necessity of carrying three basic types of bags, (1) a garment bag, (2) a suitcase, and (3) a briefcase. The garment bag is normally configured to carry suits or dresses in an unfolded, or loosely folded, condition. As such, it has a long dimension and is inconvenient to carry. Most garment bags must be carried over an arm. The suitcase is designed to carry other items of clothing, and is configured and sized, and provided with a handle, all designed to provide a bag which can be conveniently carried, stowed, or set upright on a floor or table. The briefcase usually has a multiplicity of compartments for carrying office items such as pens, pencils, papers, books, a calculator, etc.

When boarding an airplane, the passenger normally checks the suitcase through to his destination, stows the garment bag in a forward closet in the passenger compartment, and carries the briefcase. At times, if the garment bag or suitcase is small enough it may be stowed in an overhead compartment or under a seat. However, in any event, the problem of dealing with three different bags presents an inconvenience to the traveler.

There are some existing garment bags that can be folded in half so as to reduce the length of the bag and allow it to be carried by a handle provided at the fold. While this makes the bag more convenient to carry, it does not, even when the halves are secured together, provide a bag which can be easily placed in an airplane's overhead compartment or stowed under a seat. Further, such bags lack the packing space of a suitcase and do not generally take the place of a suitcase. Combination garment bags and suitcases usually take the form of a a foldable suitcase and approximate the size of large suitcases. As such, they cannot be carried on an airplane, but must be checked. Currently available carry-on bags are sized to fit under an airplane seat, but do not offer the packing convenience of a garment bag for suits and jackets which must be folded into a small size to fit into the carry-on bags with resulting wrinkling.

With the current state of air travel where there are commonly long lines to check baggage, long waits after a plane arrives at its destination to retrieve checked baggage, and the constant possibility of loss of baggage that is checked, many travelers prefer to utilize carry-on luggage. However, there are no existing bags that combine all the desirable features wanted by a traveler, such as (1) a single bag which can be folded into a small enough configuration, and is resilient enough, that it can be stowed under a passenger seat or in an overhead compartment of an airplane; (2) a bag that can be carried and handled and set on a floor as conveniently as a suitcase; and (3) a bag that can serve simultaneously as a garment bag, suitcase, and briefcase. There is clearly room for improvement in the carry-on luggage area.

SUMMARY OF THE INVENTION

According to the invention, a bag is provided which serves as a garment bag and a suitcase, and may also serve as a brief case. The bag can be folded into three sections such that it can be made small enough to slide under the seat in a passenger airplane, and, in its folded configuration, it can be conveniently carried or set on a floor like a suitcase. In addition, in its folded configuration, it can be utilized as a briefcase, with easy access to materials therein. And, in its unfolded configuration, it can be treated as a garment bag.

The suitcase-garment bag of the invention includes flexible, elongate, substantially rectangular front and rear panels interconnected along their sides, tops and bottoms to form an interior space between the panels into which clothing on clothing hangers may be placed. A closeable opening provides access to the interior space. Bottom means are preferably secured to the rear panel intermediate its length and positioned so that the bag may be folded into substantially three overlapping sections with the bottom means providing a bottom for the bag upon which it can stand when in folded configuration. Means such as straps with buckles are provided to secure the bag in folded configuration and a handle, such as a pair of loops extending from opposite sides of the bag in folded configuration, is provided for carrying the bag in folded configuration. It is preferred that a substantially rigid, transverse stiffening member be secured to the back panel intermediate its length and positioned to be substantially at the top of the bag when the bag is in folded configuration. This helps the bag maintain its shape and prevents it from sagging when in folded configuration, particularly when standing or being carried.

Various sized and shaped pockets and compartments are preferably provided in the front panel so that separate pockets are located in separate sections of the bag when folded. The pockets in one section of the bag are constructed to expand outwardly when filled while the pockets in another section are constructed to expand inwardly when filled to facilitate the folding of the sections into overlapping configuration. The various pockets may be used for holding clothing items such as shirts, shoes, ties, undergarments, dresses, suits, coats, etc., and also office items such as pens, pencils, calculator, stationery, papers, books, etc.

THE DRAWINGS

In the accompanying drawings, which illustrate the best mode presently contemplated for carrying out the invention:

FIG. 1 is a front elevation of the bag in its unfolded configuration;

FIG. 2, a rear elevation of the bag in its unfolded configuration;

FIG. 3, a left side elevation of the bag in its unfolded configuration;

FIG. 4, a front perspective view of the top and front of the bag in its folded configuration with a pocket flap cut away;

FIG. 5, a side elevation of the bag in folded configuration;

FIG. 6, a vertical section taken on the line 6—6 of FIG. 1 and drawn to a larger scale; and FIG. 7, a fragmentary vertical section taken on the line 7—7 of FIG. 1 and drawn to a larger scale.

DETAILED DESCRIPTION OF THE ILLUSTRATED EMBODIMENT

Figure 1:
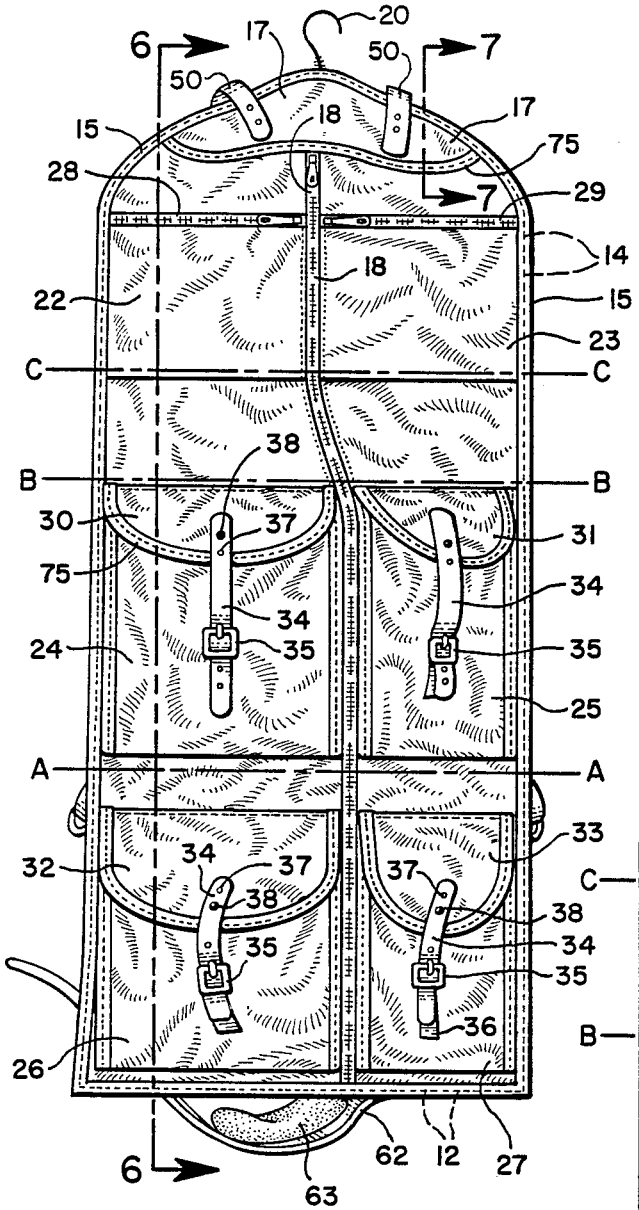
Figure 2:
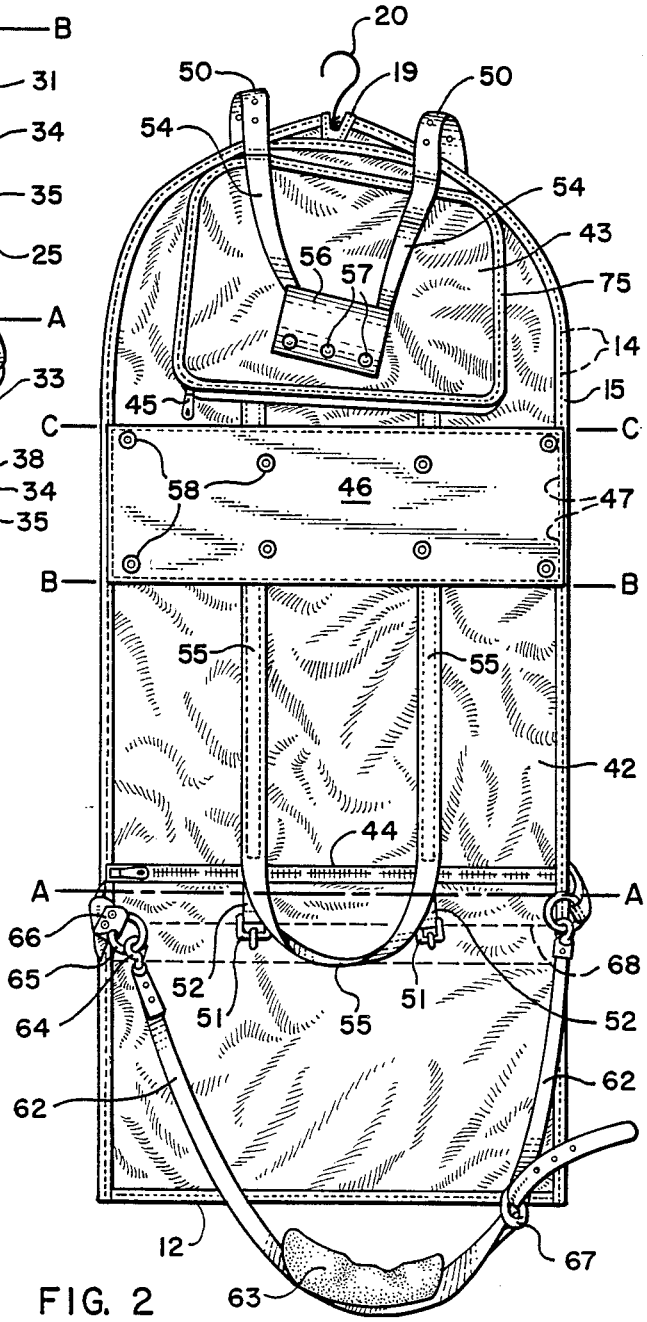
Figure 3:
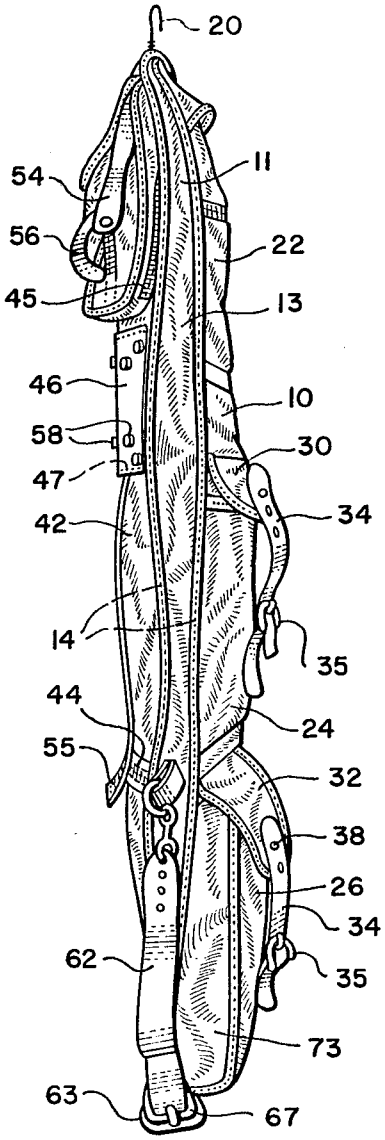
Figure 7:
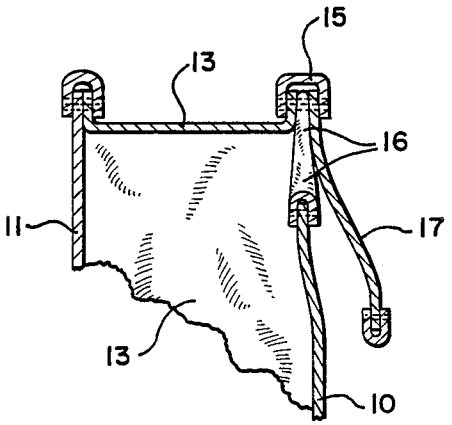
Figure 6:
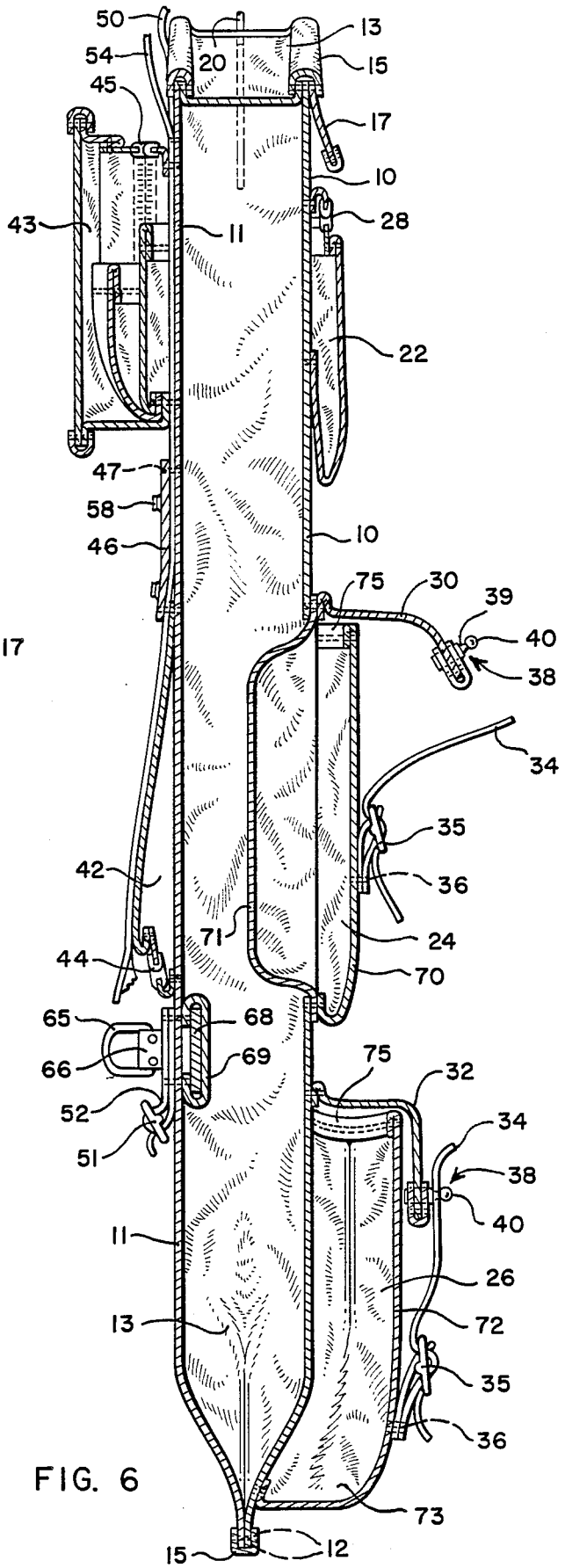

A foldable, multipurpose suitcase-garment bag is made up of a front panel 10 and a rear panel 11, FIGS. 3 and 6, joined together directly at their bottoms by stitching 12 and joined together along their sides and tops by a spacing strip 13. The spacing strip 13 is secured along its edges to the edges of the sides and tops of the panels by stitching 14, FIGS. 1, 2, and 3. The stitched edges are preferably reinforced with a strip of binder material 15. In this way, the front and rear panels 10 and 11 are secured together to form an interior space between the panels to receive clothes in normal fashion as with a normal garment bag. Spacer strip 13 allows the panels to move away from one another to expand the interior space as needed for the clothes placed therein. Front panel 10 preferably does not extend completely to the top of the bag, as shown in FIG. 7, so as to leave a partial top front opening 16. This opening is covered by flap 17 secured to the top front edge of spacer strip 13. A zippered opening 18, FIG. 1, provides access to the interior space of the bag and an opening 19 at the top of the bag, FIG. 2, provides an opening for clothes hanger hooks, one such hook 20 being shown to extend therethrough in normal fashion. The combination of zippered opening 18 and partial top opening 16 allows for easy entrance and exit of clothing on clothing hangers into and out of the bag's interior space.

Six pockets 22, 23, 24, 25, 26, and 27 are provided on the front panel 10, FIGS. 1, 3, and 6. These may conveniently hold clothing items such as underwear, socks, and shirts, travel accessories, such as a toiletry bag, or other items such as shoes, camera, etc. Zippered opening 18, FIG. 1, which allows access to the interior of the bag, preferably runs substantially from top to bottom of the bag being centrally located near the top between pockets 22 and 23 and then extending diagonally toward one side of the bag, as shown, before extending the rest of the distance downwardly nearer one side than the other so that pockets 24 and 26 on one side of the opening are wider than pockets 25 and 27 on the other side of the opening. This allows much more flexibility in packing the bag, and allows provision of pockets wide enough to hold two pairs of shoes.

Pockets 22 and 23 are provided with zippers 28 and 29, respectively, for closing the mouths of the pockets.

Pockets 24, 25, 26, and 27 are provided with fabric flaps 30, 31, 32, and 33, respectively, sewn to the front panel above the pockets for closing over the mouths of the pockets.

Pockets 24, 25, 26, and 27 are also each provided with leather straps 34 and cooperating buckles 35 for fastening the flaps in place. The lower ends of straps 34 are attached, as by stitching, to the material forming the respective pocket fronts, as at 36, and, while buckles 35 provide a range of adjustment for straps 34, it is preferred that rather than securing the tops of straps 34 to the respective flaps as by stitching, that for easy opening of the flaps, the straps be provided with small openings 37 toward their upper end which fit over and are held in place by fasteners 38 which include a stem 39 with enlarged ball 40 which fits through a selected opening 37 to hold the strap 34 to its respective pocket flap as shown in FIG. 6. This makes it easy to quickly release and secure the flaps.

Additional pockets 42 and 43 are provided on the rear panel of the bag, FIGS. 2 and 6. Pocket 42 is provided on an intermediate portion on back panel 11 and is closed by zipper 44 while pocket 43 is provided on the upper portion of back panel 11 and is closed by zipper 45 which perferably extends completely about three sides of the pocket.

A bottom means 46 is secured, such as by stitching 47, to back panel 11 intermediate its length as shown in FIGS. 2, 3, and 6. While the bag itself is made of relatively flexible material such as canvas, nylon, leather, or vinyl, the bottom means 46 is made of relatively inflexible material, such as a thick piece of leather or a piece of plastic or fiberglass.

Figure 5:
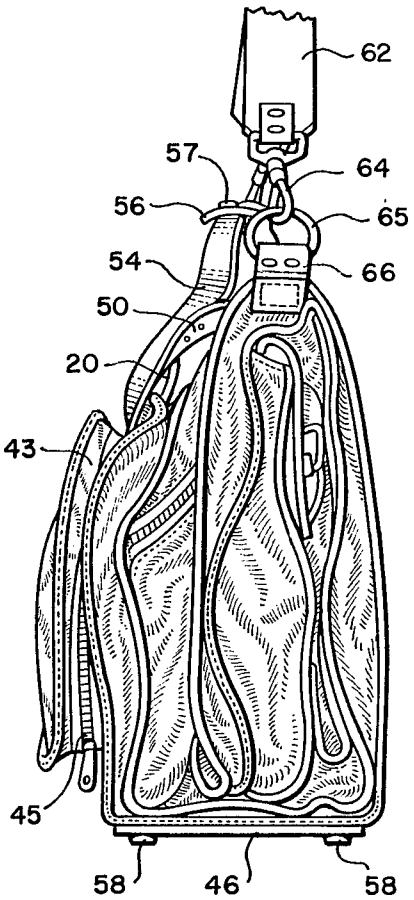
Figure 4:
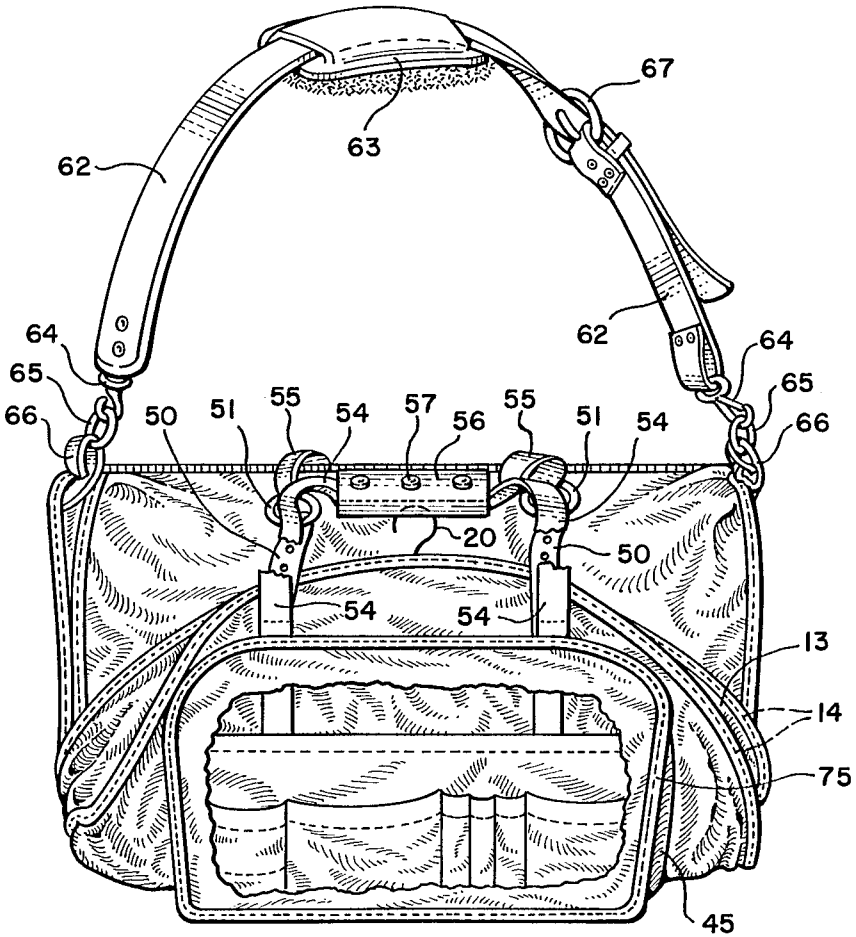

The bag is adapted to be folded upon itself in three overlapping sections to form a compact suitcase-like shape as shown in FIGS. 4 and 5. For this purpose, the arrangement of the pockets on the front and rear panels of the bag and the placement of the bottom means on the rear panel are arranged to provide substantially three transverse bag folding axes.

Phantom lines A-A, B-B, and C-C, FIGS. 1 and 2, represent three transverse axes. These axes divide the bag into four sections, a lower section being that from the bottom of the bag to axis A-A; a center section being that from axis A-A to axis B-B; a folded-configuration suitcase bottom section being that from axis B-B to axis C-C; and an upper section being that from axis C-C to the top of the bag.

To place the bag in a folded configuration, the lower section is folded inwardly along axis A-A such that it lies essentially flat and on top of the center section. The upper portion of the bag is then folded inwardly approximately 90° along axis B-B. The upper section of the bag is then folded inwardly approximately another 90° along axis C-C such that it lies essentially flat on top of the lower section of the bag. The bag is then fastened in this configuration by straps 50, FIGS. 2 and 4, secured to the top of the bag which mate with buckles 51 on straps 52 which extend from the back panel of the bag in the area of axis A-A. A carrying handle for the bag is formed from strap loops 54 and 55 which are secured together when the bag is in folded configuration by flexible connecting piece 56 secured to loop 54 so that when loop 55 is placed adjacent loop 54, connecting piece 56 is wrapped around both loops and secured in that configuration, such as by snaps 57. In folded configuration, the bag may be set upright, like a suitcase, with the relatively inflexible bottom material 46 serving as a bottom for resting on a floor, table, or other surface. Feet 58 may be provided extending from bottom means 46 for the bag to rest on. Single strap loop 54 provides a handle for the bag when in its unfolded configuration.

While the three axes described divide the bag into four sections, as described, it is the three sections described as the lower section, center section, and upper section that fold upon themselves and overlap as shown in FIG. 5. The suitcase bottom section, that between axes B-B and C-C, provides a bottom and also provides for the spacing required between the center and upper sections to allow the lower section to fit therebetween when folded. As shown in the drawings, axis A-A is located approximately two-thirds of the distance down from the top of the bag while the axes B-B and C-C are both located approximately one-third of the distance down from the top of the bag, but are spaced apart to provide for the bottom means. Thus, axis B-B will generally be located somewhat more than one-third of the way down while axis C-C will be located somewhat less than one-third of the way down, the exact distance being determined by the size of the bottom means which is somewhat dependent on the size and configuration of the bag. However, for the purposes of this application, both axes may be considered as located approximately one-third of the way down.

A shoulder strap 62 with padded shoulder rest 63 thereon, FIGS. 2 and 4, may be provided in addition to the bag handle for carrying the bag on a shoulder when in folded condition. Strap 62 is preferably removably secured to the bag by clips 64 mounted at the ends of strap 62 which are removably secured in normal manner to rings 65 secured to the bag by loops 66 of material stitched to the bag. The length of strap 62 is adjustable by means of buckle 67.

A stiffening member 68, FIG. 6, such as a fiberglass, plastic, or metal slat or a piece of any other type of substantially rigid material, is provided in the rear panel of the bag positioned to be at the top of the bag when in folded configuration. This stiffening member, shown in FIG. 6 in a receiving pocket formed by material 69 sewn to back panel 11, forms the top of the bag and keeps the top of the bag from sagging when the bag is in folded configuration. It also helps the bag maintain its shape in folded condition when being carried by either the handle or shoulder strap. It is preferred that the rings 65 for attachment of the ends of the shoulder strap be secured to the bag adjacent the ends of the stiffening member.

Pocket 43 on the top portion of rear panel 11 is preferably sized to act as a brief case, and has internal pockets therein, as shown in FIG. 4 in which the flap of pocket 43 is broken away to show the interior. These internal pockets are suitable for holding items normally carried in a brief case such as paper, pens, pencils, calculator, ruler, etc.

A feature of the present invention which allows more even folding of the bag sections upon themselves is providing for one of the pairs of pockets 24 and 25 and 26 and 27, FIGS. 1, 3, and 6, to expand inwardly into the interior of the bag when filled and the other pair to extend outwardly away from front panel 10 when filled. This prevents both pairs of pockets from expanding outwardly when filled which would make it difficult to fold the bottom section over upon the central section. As shown in FIG. 6, pockets 24 and 25 are constructed with the outer material 70 forming each pocket secured directly about the edges to the front panel 10 and with pocket backing material 71 extending into the interior of the bag. As pockets 24 and 25 are packed, they will expand into the interior of the bag rather than outwardly. Conversely, the backs of pockets 26 and 27 are formed by front panel 10 and the material 72 forming each pocket 26 and 27, while secured at the bottoms directly to bag front panel 10, include side expansion pieces 73 about their sides so that upon packing pockets 26 and 27, they expand outwardly.

In addition to using a strip of binder material 15 about the edges of the front and rear panels when they are stitched together or stitched to the spacer strip 13 as described, it is preferred to include similar binder material 75 about all exposed seams and about all exposed material edges to reinforce them and prevent fraying of such edges. The binder material may be material similar to that used for the bag or may be contrasting material. Strips of flexible leather or nylon are satisfactory.

The pockets of the present invention are designed to provide packing room in addition to the garment bag comparable to other carry-on luggage so that the bag of the invention takes the place of a separate garment bag and separate carry-on bag. Thus, the smaller upper pockets on the front panel, 22 and 23, FIG. 1, may be used for small items such as money or jewelry, while the larger pockets on the front panel, 24, 25, 26, and 27, may be used to store bulky items such as shoes, toiletry kit, camera, socks, underwear, etc. Either of the wider pockets 24 or 26 can accommodate two pairs of shoes, and with the pocket construction described where one pocket extends inwardly into the bag while the other extends outwardly, bulky items can be packed in all pockets 24, 25, 26, and 27 and the bag will still fold easily and completely. The pocket 42 on the rear panel of the bag will accommodate relatively flat items such as folded shirts or other clothing items. The pocket 43 on the rear panel, as previously indicated, will accommodate various brief case items such as paper, pencils, pens, magazines, etc. Pocket 43 is positioned to be on the outside of the bag when the bag is in its folded configuration so is easily accessible for items to be used during the time of travel itself.

While a certain configuration of pockets and certain location for the opening into the interior space of the bag have been shown and described, various other configurations can be used and various locations for the opening could be used. Further, various closure means other than the described zippers, flaps and straps with buckles could be used such as velcro fasteners or buttons. For example, the pockets 24, 25, 26, and 27 could be closed with zippers rather than flaps and straps.

Also, while the bottom means 46 has been described as secured to the outside of the rear panel, it could easily be secured to the inside face of the panel or otherwise be secured on a face or in the panel or may be incorporated as part of the panel itself, as, for example, being sewn in as an integral part of the panel or in a pocket such as shown for stiffening member 68. Similarly, stiffening member 68 may be secured to the bag in a variety of ways. In addition, while the bottom means has been described as relatively inflexible, this is in relation to the relatively flexible material which makes up the rest of the bag. The bottom means does not have to be relatively rigid to be effective.

The bag may be made of various materials with presently preferred material being either canvas with leather trim or nylon with nylon trim.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A foldable, suitcase-garment bag comprising:

flexible, elongate, substantially rectangular front and rear panels;

interconnecting means interconnecting the bottoms, sides, and at least a portion of the tops of said front and rear panels to form an interior space between said panels;

a closeable opening for gaining access to the interior space between the panels;

bottom means secured to said rear panel intermediate its length whereby the bag may be folded into substantially three overlapping sections with the bottom means providing a bottom for the bag upon which it can stand when in folded confirguration;

a substantially rigid stiffening member secured to the rear panel and extending transversely thereof and located intermediate the length of said panel so as to be substantially at the top of the bag when the bag is in its folded configuration;

means for securing the bag in its folded configuration; and handle means for carrying the bag in its folded configuration.

2. A bag in accordance with claim 1, wherein the interconnecting means includes a flexible elongate spacing strip secured to the periphery of the front and rear panels along at least the sides and a portion of the tops thereof to expandably interconnect said panels.

3. A bag in accordance with claim 1, wherein there is additionally included a shoulder strap for carrying the bag in its folded configuration and wherein there are means securing the respective ends of the shoulder strap to the bag adjacent opposite ends of the stiffening member.

4. A foldable, suitcase-garment bag comprising:

flexible, elongate, substantially rectangular front and rear panels;

interconnecting means interconnecting the bottoms, sides, and at least a portion of the tops of said front and rear panels to form an interior space between said panels;

a closeable opening for gaining access to the interior space between the panels;

bottom means secured to said rear panel intermediate its length whereby the bag may be folded into substantially three overlapping sections with the bottom means providing a bottom for the bag upon which it can stand when in folded confirguration;

a plurality of pockets on the front panel, separate pockets being located to be within separate sections of the bag when in folded configuration;

means for securing the bag in its folded configuration; and handle means for carrying the bag in its folded configuration.

5. A bag in accordance with claim 4, wherein the closeable opening is generally vertically arranged in the front panel and pockets of the plurality of pockets are located on opposite sides of the closeable opening.

6. A bag in accordance with claim 5, wherein the closeable opening through at least a portion of its length is closer to one side of the bag than the other whereby the pockets on one side of the opening are wider than the pockets on the other side.

7. A bag in accordance with claim 4, wherein the pockets located within one section of the bag are adapted to expand inwardly into the interior space between panels when filled and the pockets in an adjacent section are adapted to expand outwardly from the front panel when filled so that the adjacent sections with pockets filled may be folded over, one upon the other.

8. A bag in accordance with claim 4, wherein there is additionally included at least one pocket in the rear panel.

9. A bag in accordance with claim 1, wherein the handle means includes a pair of looped straps, each member of the pair extending from opposite sides of the bag when in folded configuration, wherein each loop is long enough so that the loops may be brought together above the top of the bag when the bag is in folded configuration, and a connecting means adapted to be wrapped about the looped straps when brought together to hold said loops together and provide a handle for carrying the bag.

10. A foldable, suitcase-garment bag comprising:

flexible, elongate, substantially rectangular front and rear panels;

interconnecting means interconnecting the bottoms, sides, and at least a portion of the tops of said front and rear panels to form an interior space between said panels;

a closeable opening for gaining access to the interior space between the panels;

means for providing three transverse folding axes, the first of said transverse axes being approximately two-thirds of the distance down from the top of the bag, the second transverse axis being approximately one-third of the distance down, and the third transverse axis also being approximately one-third of the distance down but spaced from the second axis to thereby divide the bag into a lower section, a center section, a folded-configuration suitcase bottom section, and an upper section, the means for providing the first transverse axis comprising a substantially rigid stiffening member secured transversely of the bag;

bottom means secured to the rear panel and positioned between the second and third of said transverse folding axes to provide a bottom upon which the bag can stand when in its folded configuration;

means for securing the bag in its folded configuration; and handle means for carrying said bag in its folded or unfolded configuration.

11. A bag in accordance with claim 10, wherein the means for providing the second and the third tranverse folding axes are the respective longitudinal edges of the bottom means for the bag.

12. A bag in accordance with claim 10, additionally including at least one pocket on the front panel, and wherein each of the at least one pockets is wholly within one of said sections.

13. A foldable, suitcase-garment bag comprising:

flexible, elongate, substantially rectangular front and rear panels;

interconnecting means interconnecting the bottoms, sides, and at least a portion of the tops of said front and rear panels to form an interior space between said panels;

a closeable opening for gaining access to the interior space between the panels;

means for providing three transverse folding axes, the first of said transverse axes being approximately two-thirds of the distance down from the top of the bag, the second transverse axis being approximately one-third of the distance down, and the third transverse axis also being approximately one-third of the distance down but spaced from the second axis to thereby divide the bag into a lower section, a center section, a folded-configuration suitcase bottom section, and an upper section, bottom means secured to the rear panel and positioned between the second and third of said transverse folding axes to provide a bottom upon which the bag can stand when in its folded configuration;

pockets in at least two sections of the front panel, each pocket attached to one of the sections having as its rear side the front panel of the bag so that when filled, the pocket will expand outwardly from the panel, and each pocket attached to one adjacent section having a rear side of the pocket positioned in an opening in the front panel so that when filled, the pocket will expand inwardly from the panel;

means for securing the bag in its folded configuration; and handle means for carrying said bag in its folded or unfolded configuration.

14. A bag in accordance with claim 10, wherein the means for fastening said bag in its folded configuration comprises at least one strap secured to the top of the rear panel of said bag and cooperating buckle means secured to the rear panel of said bag near the junction of the bottom and middle sections.

15. A bag in accordance with claim 10, wherein the means for providing a carrying handle includes a first strap fashioned into a loop with its ends attached to the top of the rear panel of said bag, a second strap fashioned into a loop with its ends attached intermediate the rear panel of said bag, and a cooperating flexible rectangular member which can be wrapped around both loops and itself fastened into a closed loop about said loops formed by the first and second straps.

16. A bag in accordance with claim 15, wherein the first strap together with the cooperating flexible rectangular member serves as a carrying handle for the bag when in its unfolded configuration.

17. A foldable, suitcase-garment bag comprising:

flexible, elongate, substantially rectangular front and rear panels;

interconnecting means interconnecting the bottoms, sides, and at least a portion of the tops of said front and rear panels to form an interior space between said panels;

a closable opening for gaining access to the interior space between the panels;

a plurality of pockets in the front panel, said pockets being arranged so that the bag may be folded into substantially three overlapping sections wherein separate pockets are located in at least two separate sections of the bag and wherein the pockets located within one section are adapted to expand outwardly from the front panel when filled and the pockets in the other section are adapted to expand inwardly from the front panel when filled so that the sections may be folded into overlapping relationship;

means for securing the bag in its folded configuration; and handle means for carrying the bag in its folded configuration.

18. A bag in accordance with claim 17, wherein a pair of pockets are included in at least each of two sections of the bag and wherein one pocket of each pair is wider than the other pocket of the pair.

19. A bag in accordance with claim 10, wherein, when the bag is in folded condition, the lower section is positioned between the center section and upper section of the bag.

* * * * *